United States Patent [19]

Neill et al.

[11] 4,033,807

[45] July 5, 1977

[54] SYSTEM FOR PRODUCING TWO-WAY MAILER

[75] Inventors: Jimmie Neill, Hatboro, Pa.; Lester V. Wise, Old Westbury, N.Y.

[73] Assignee: Federal Business Products, Inc., New York, N.Y.

[22] Filed: Jan. 5, 1976

[21] Appl. No.: 646,857

Related U.S. Application Data

[63] Continuation-in-part of Ser. No. 620,323, Oct. 7, 1975, Pat. No. 3,977,597.

[52] U.S. Cl. ..... 156/384; 93/61 R; 93/61 AC; 93/73; 101/231; 101/262; 101/267; 156/442.1; 156/442.2; 271/2

[51] Int. Cl.[2] ..... B41L 47/42

[58] Field of Search ..... 156/277, 384, 441.5, 156/442.1, 442.2, 442.3, 566; 101/229, 231, 262, 263, 264, 265, 266, 267; 93/61 R, 61 AC, 73; 271/2; 229/73, 92.1, 92.8

[56] References Cited

UNITED STATES PATENTS

| | | | |
|---|---|---|---|
| 2,720,833 | 10/1955 | Lindon | 229/92.8 |
| 2,867,167 | 1/1959 | Mitchell | 101/229 |
| 3,250,456 | 5/1966 | Schuessler | 229/92.1 |
| 3,373,989 | 3/1968 | Baron | 271/2 |
| 3,602,114 | 8/1971 | Peters | 93/61 R |
| 3,606,951 | 9/1971 | Sather et al. | 271/2 |

*Primary Examiner*—Caleb Weston

[57] ABSTRACT

A system for manufacturing two-way mailers constituted by a single blank imprinted with data on both faces thereof, the blank then being formed into superposed panels that not only define pre-addressed forwarding and return envelopes but also a printed statement of charges and a return stub to accompany payment, thereby making it possible for a company to forward to a customer a statement of charges and for the customer to remit to the company. In the system, the blanks are individually printed on both faces thereof in a printing stage that includes a conveyor loop wherein fresh blanks admitted into the loop are fed under the printing head for imprinting on one face thereof, each blank then being turned over and advanced on the loop toward a two-position output gate. In its first position, the gate passes the blank into a reentry mechanism acting to readmit the turned-over blank into the loop for imprinting on the other face thereof. The blank printed on both faces at the completion of the loop circuit is discharged by the gate, in its second position, into succeeding stages of the system in which the blank is folded and finished to form the two-way mailer.

10 Claims, 9 Drawing Figures

33E
33D
33C
33B
33A
ALIGNMENT MECHANISM (RA)
37
35
VACUUM CHAMBER
39
VACUUM CHAMBER
43
44B
44A
44C
47
31A
31C
31
31B
46A
46
46B
RG
CLUTCH
CLUTCH
REGISTER MECHANISM
RM
R
RE-ENTRY MECHANISM (EM)
45
PRINTING HEAD
24
HIGH VAC
36
34
38
41
VACUUM CHAMBER
CONVEYOR LOOP
42
42A
42B
OG
TO FOLDING STAGE

SYSTEM FOR PRODUCING TWO-WAY MAILER

RELATED APPLICATION

This application is a continuation-in-part of copending application Ser. No. 620,323, filed Oct. 7,1975, entitled "One-Piece, Two-Way Mailer," now issued as U.S. Pat. No. 3,977,597 (Aug. 31, 1976).

BACKGROUND OF INVENTION

This invention relates generally to a manufacturing system for printing paper blanks on both faces thereof and then folding or otherwise processing the printed blank to form a finished piece, and more particularly to a system for producing a two-way mailer assembly constituted by a single blank which is formed into superposed panels that not only define pre-addressed forwarding and return envelopes but also a printed statement and a return stub to accompany payment, making it possible for a company to forward to a customer a statement of charges and for the customer to remit to the company.

It is customary for a large company such as a telephone company, an electric power utility, a large department store, or for that matter any other commercial facility which sells goods or renders services to a multiplicity of customers to bill each customer on a monthly or other periodic basis.

It has heretofore been the practice for the company to enclose a statement of charges in a forwarding envelope addressed to the customer. The statement is generally in the form of a card having a transverse perforation forming a stub identifying the account and the amount owing. Also inserted in this envelope is a return envelope for payment, as well as advertising folders and other types of material relating to the company's business. The customer receiving this pack of material is expected to send back his payment check and the stub section of the statement in the return envelope.

While the preparation of bills for customers and the addressing of the forwarding envelopes are now carried out by high-speed computer techniques, it has heretofore been necessary to employ special machines for stuffing the forwarding envelope with the return statement of charges, the return envelope and the other material forming the pack. This is not only a time-consuming and costly operation, but because of machine or human error, it gives rise to troublesome mistakes.

In the above-identified copending application, the entire disclosure of which is incorporated herein by reference, there is disclosed a two-way mailer assembly created from a single rectangular paper blank that is indented, perforated and folded to create four superposed panels, defining a forwarding envelope and return envelope as well as a statement of charges, a return stub and a duplicate return stub, the components of the assembly being separable from each other.

A significant advantage of this two-way mailer is that the printed statement of charges for the customer and the stub to be sent back to the company are not separate inserts but form components of the assembly that are severable therefrom by the receiving customer, the customer retaining the statement and inserting the return stub and his remittance in the return envelope. The two-way mailer disclosed in the copending application lends itself to use in conjunction with computer-controlled direct-image printing ink-jet transfer apparatus for imprinting the customer addresses, the statement of charges and all other necessary data.

Inasmuch as the statement of charges and other data relevant to a particular account must be imprinted on one face of the blank, and addresses and other information relevant to the same account must be imprinted on the other face, this creates a major problem in producing the two-way mailer at high speed and at relatively low cost when using ink-jet printing heads or computer-controlled printers which function in a similar manner.

An ink-jet printing head is adapted to project ink downwardly onto paper; hence printing can only be carried out with the paper passing below the head. When, therefore, a given blank is imprinted on one face, it must be turned over to effect printing on the other face. The obvious arrangement for this purpose is a set-up employing two printing heads, one for each face, the blank being reversed after it leaves the first head and before entering the second head.

But apart from the fact that ink-jet printers are expensive and the need for two printing heads adds substantially to the overall cost of the system, the use of two printers introduces other complications. The printers are responsive to data derived from a computer, and, since data relating to a given account must be imprinted in part by one printer and in part by the other, the operation of the two printers must be carefully coordinated to be sure that the data imprinted by the second printer on the opposite face of a given blank is related to the same account.

Moreover, since one must associate with the input of each printing head an alignment mechanism for the blank, a separate alignment mechanism is required in conjunction with each printing head.

SUMMARY OF INVENTION

In view of the foregoing, it is the main object of this invention to provide a high-speed system for printing paper blanks on both faces thereof by means of a single printing head. In some applications, the system is adapted to fold and otherwise process each printed blank to form a finished piece.

While the invention will be described in conjunction with the production of a two-way mailer of the type disclosed in the above-identified copending patent application, it will be appreciated that the system is not limited to two-way mailers and may be used for other applications requiring printing on both faces of a blank. For example, the invention is applicable to computer print-outs in which the ability to print computer data on both sides of a sheet at high speed effects significant economies in operating costs.

More specifically, it is an object of this invention to provide a system adapted to print blanks on both faces thereof by means of a single printing head, the printing stage of the system including a conveyor loop, whereby each blank admitted into the loop is fed under the printing head for imprinting on one face thereof, the blank then being turned over by the loop and advanced toward a two-position output gate which in its first position passes the blank into a reentry mechanism which acts to readmit the blank into the loop for imprinting on the other face thereof, the blank at the completion of its second run on the loop being discharged by the gate in its second position into the succeeding stages of the system.

Also an object of the invention is to provide a system of the above-type in which the blanks discharged from the printing stage enter a folding stage in which the blank is folded to form a two-way mailer whose forwarding section is folded over its return section, but is not adhered thereto, inserts being stuffed between the folded sections of the mailer by an insert stage before the sections are adhered together in a finishing stage.

Yet another object of this invention is to provide a multi-stage system adapted to manufacture two-way mailers efficiently, inexpensively and at a high production rate.

Briefly stated, in a preferred embodiment of a system in accordance with the invention, a paper web drawn from a zigzag stack is fed through a burster stage which severs the web into individual blanks which are then fed into a register mechanism. This mechanism acts to admit the blanks periodically into the conveyor loop of a printing stage having a single printing head which is computer-controlled to imprint data on one face of the blank passing thereunder, the blank then being turned over by the loop and being advanced toward a two-position output gate which, in its first position, passes the blank into a reentry mechanism.

The reentry mechanism operates alternately with respect to the register mechanism and serves to readmit the turned blanks into the conveyor loop in the intervals between the periodic admissions of blanks by the register mechanism. The readmitted blanks are imprinted on their other face and advanced by the loop toward the output gate, which now, in its second position discharges the blanks into the succeeding stages of the system for folding insertion and finishing.

OUTLINE OF DRAWINGS

For a better understanding of the invention as well as other objects and further features thereof, reference is made to the following detailed description to be read in conjunction with the accompanying drawings, wherein:

FIG. 9 is a more detailed schematic diagram of the printing stage of the system.

DESCRIPTION OF INVENTION

The Two-Way Mailer

Before describing the system in accordance with the invention, we shall first describe the two-way mailer to be produced by the system. The mailer is formed from a paper blank.

Figure 1:
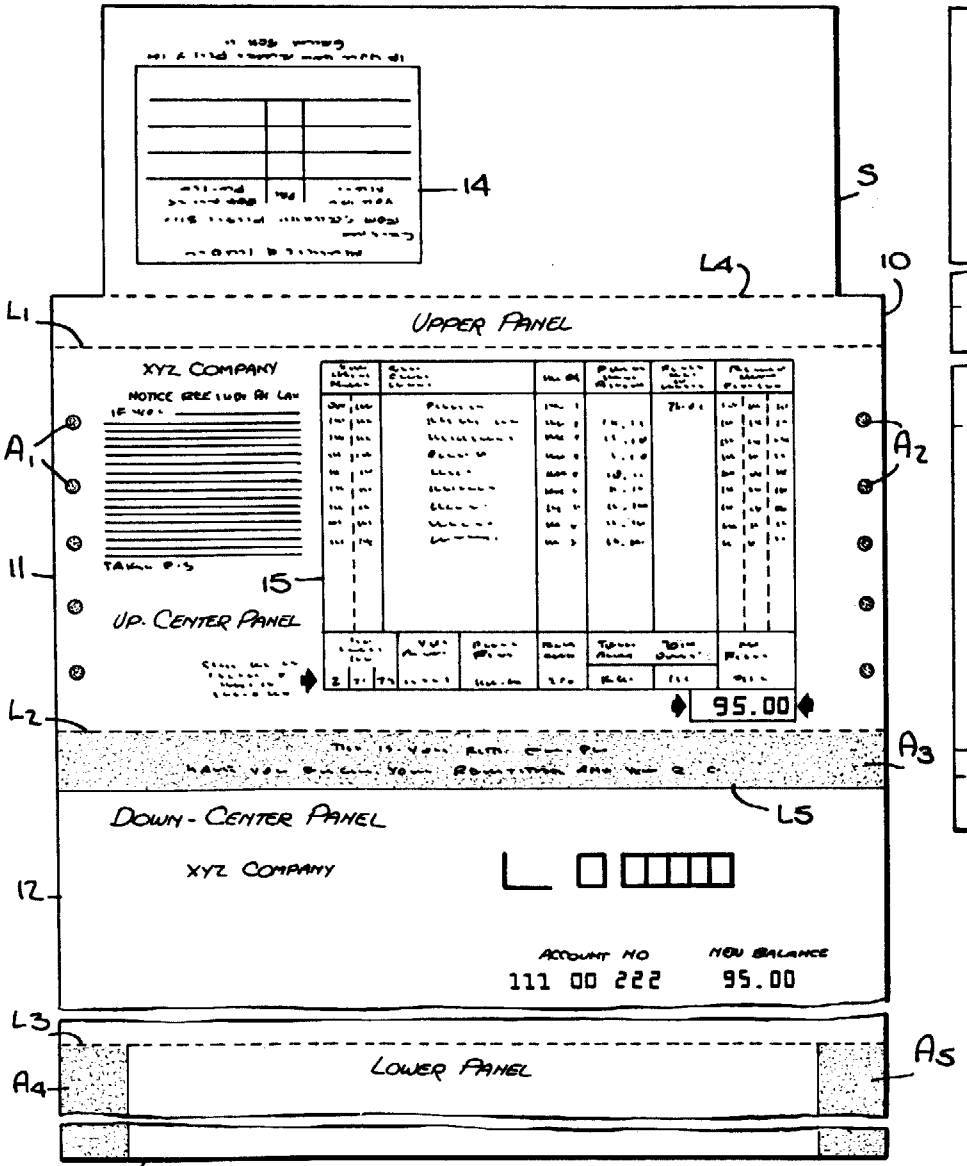
FIG. 1 is a front face view of a blank for forming a two-way mailer assembly to be produced by a system in accordance with the invention.

Referring now to FIG. 1, it will be seen that the front face of the blank is formed by a rectangular sheet of paper which is indented, perforated and printed, some of the printed matter being of the standard press type and the remaining printed matter representing computer entries. We shall, by way of example, assume that the two-way mailer assembly is intended for billing customers of the X-Y-Z Company and that one of these customers is John Smith.

In practice, this blank is formed by cutting into individual sheets a continuous web of paper which has been repeat-printed on a conventional rotary press to provide all of the permanent data appropriate to the two-way mailer, such as the name and address of the company, the statement form onto which the charges are to be entered and notices required by law, for such permanent data is common to all assemblies. All other data specific to individual customers is preferably entered, as will be later explained, by a computer-controlled ink jet technique.

The paper web from which the blank is cut is perforated and indented on the press and adhesive bands and spots applied thereto at selected areas. Each blank is provided with three transverse lines $L_1$, $L_2$ and $L_3$ of perforations at parallel positions, thereby dividing the blank into four distinct panels 10, 11, 12 and 13, which are severable from each other.

Line $L_2$ is approximately at the midpoint of the blank and panel 11 above this line is therefore referred to as the up-center panel, while panel 12 below this line is designated the down-center panel. Panel 10 above up-center panel 11 is referred to as the upper panel, while panel 13 under down-center panel 12 is identified as the lower panel.

Upper panel 10 is provided with a line of perforations $L_4$, which is parallel to line $L_1$, and the side margins of this panel extending to line $L_4$ are indented by die-cutting to create a stub S which may be severed from upper panel 10.

The front face of stub S has printed thereon a block form 14 entitled "Message and Inquiries" within which a customer may identify items being questioned. The blank space adjacent block 14 permits the customer to write a message to the company, for stub S is returned by the customer to the company to accompany payment.

The front face of up-center panel 11 has printed thereon a statement form 15 into which the various charges to be billed to the customer are entered and the amount now due indicated. Adjacent form 15 is a notice required by law regarding errors made in statements. Obviously, the nature of the printed material appearing on the front face of up-center panel 11 depends on the type of business being conducted by the X-Y-Z Company. For purposes of illustration, we are assuming that this company is a retail department store and that the statement lists the items purchased by the customer and their prices.

Down-center panel 12 constitutes a duplicate record form of the transaction and entered thereon is the customer's account number and the new balance which is the amount the customer must pay the company. The original record form containing the same data is on the rear side of stub S, as will be later explained. The front face of lower panel 13 is unused, for it constitutes the back of the top ply of the forwarding envelope, as will later become apparent.

On either side margin of the up-center panel 11 there is a row of adhesive spots, row $A_1$ being on one side and row $A_2$ on the other. A band of adhesive $A_3$ is applied across the upper end of panel 12 between the line of perforations $L_2$ and an unperforated line $L_5$ printed parallel thereto to demarcate the flap F of the return envelope.

Applied to the marginal sides on the front face of lower panel 13 are bands of adhesive $A_4$ and $A_5$. The adhesive is preferably one of the hot-melt type and is applied in liquid form to the front face of the sheet. The adhesive in band form serves to provide a bond which is more or less permanent and not easily disrupted, whereas the adhesive spots which have unbonded spaces therebetween form a temporary bond which is more easily disrupted.

Figure 2:
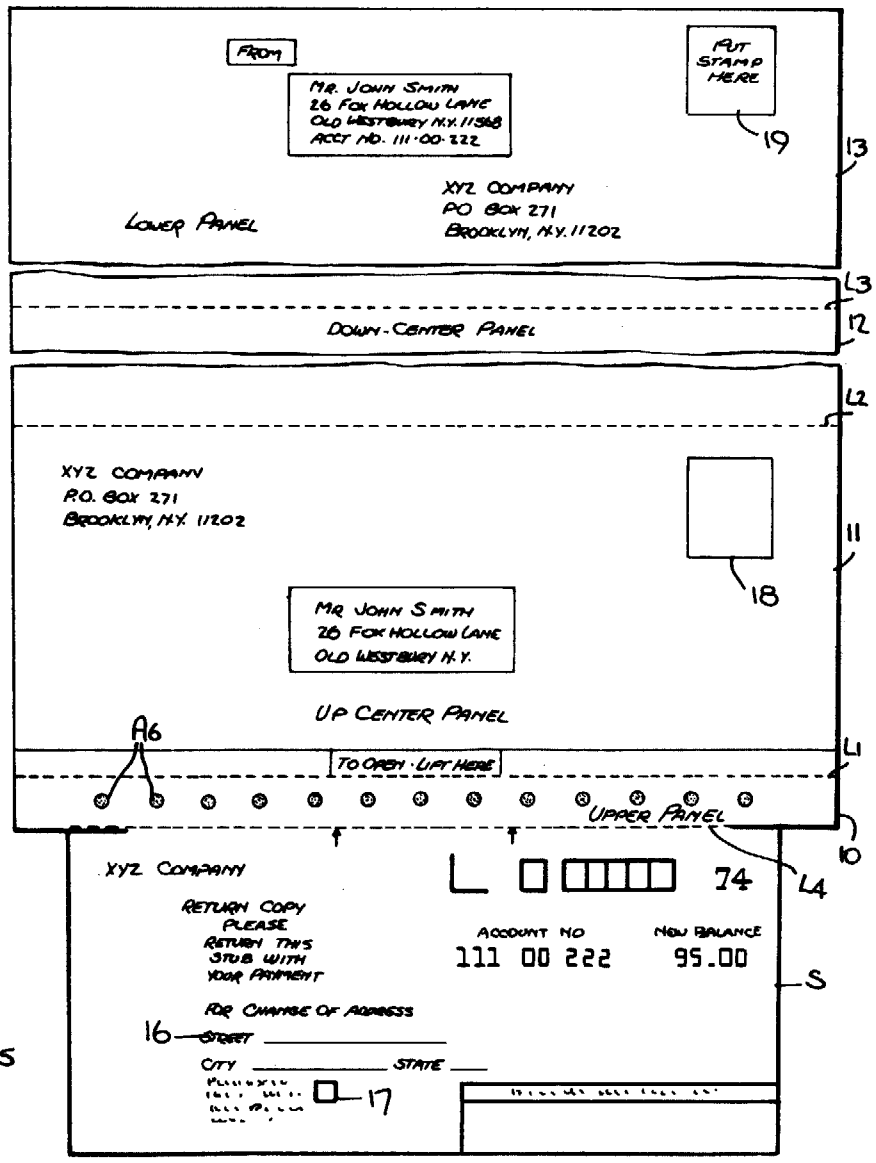
FIG. 2 is a rear face view of the same blank.

Referring now to FIG. 2 showing the rear face of the blank, it will be seen that return stub S on upper panel 10 constitutes the original record of payment and contains the customer's account number and his new balance. When the assembly is received by a customer and unfolded, this sheet is severed along perforations $L_4$ from the upper panel 10 and is returned to the company by the customer to accompany payment. The orginial return stub also contains a form 16 to indicate a change of address and a box 17 which can be checked by the customer to call attention to the fact that he has written a message on the message side of the return stub.

In the space between perforation line $L_1$ to $L_4$ on upper panel 10 on the rear face thereof is a row $A_6$ of spot adhesive. The rear face of up-center panel 11, which is the front of the completed assembly which is forwarded to the customer, has printed thereon the name and address of customer John Smith and has a space 18 for a stamp.

The rear face of down-center panel 12 is unused, for this face is the back of the completed assembly. The rear face of lower panel 13 has printed thereon the name and address of the X-Y-Z Company and has a space 19 for a stamp.

The billing and record data appropriate to the customer is preferably entered on the sheet by a Mead "Dijit" image system or an equivalent system involving direct imaging by an ink-jet system controllable by a computer. This is effected by an array of hundreds of individually-controlled ink jets, each capable of generating thousands of uniformly-spaced ink droplets per second. At the direction of a computer, the droplets are given an electrical charge or left in the neutral state. All droplets then pass through a high-voltage deflection field that allows the neutral droplets to pass through to the paper web advancing therebelow to form a portion of a letter, number or other graphic image, the charged droplets being deflected and returned to the ink reservoir.

A computer for controlling the ink-jet imaging system may include a multi-channel compatible magnetic tape on which is recorded the desired billing and customer addressing information to be imprinted on both sides of the individual blanks.

In practice, the information which is common to all customers is printed by conventional techniques on a continuous web basis, such as the company's address and the forms into which entries are to be made, whereas the data which is unique to each customer is printed by the ink-jet technique after the printed web has been cut into individual blanks.

Since data specific to any given customer is entered on both sides of the blank, it is necessary to pass the paper sheet twice through the ink jet system, and the control system therefor must ensure proper coordination of the front face and rear face entries, so that all imprinted information relates to the same customer.

Figure 3:
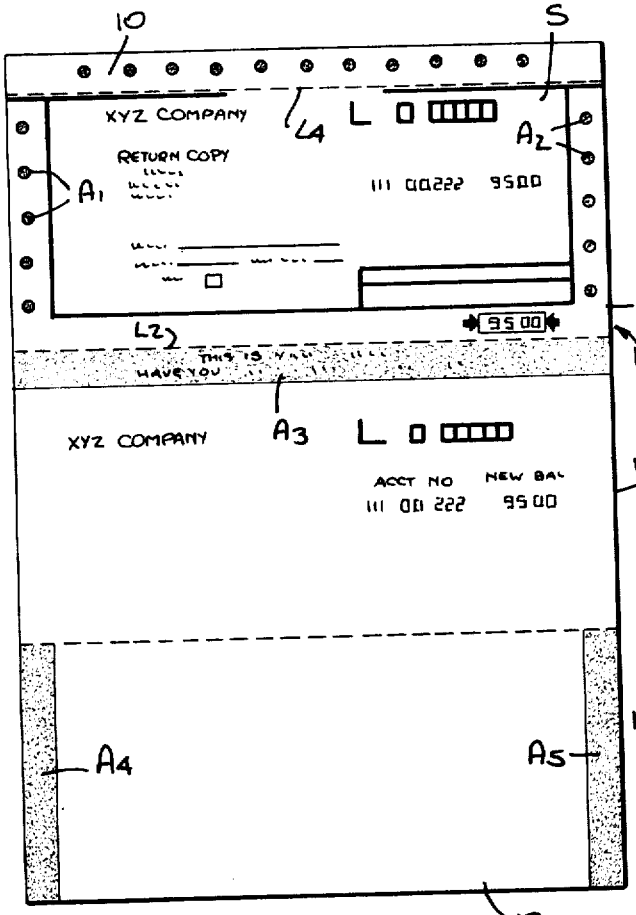
FIG. 3 shows the first folding step in creating the assembly.

As shown in FIG. 3, the first step in converting the blank into a two-way mailer involves folding the upper panel 10 over the up-center panel 11 to form a forwarding section FS. Because of the indentation in upper panel 10, the rows of spot adhesive $A_1$ and $A_2$ on the front face of the up-center panel are exposed and do not engage the sides of stub S.

The forwarding section includes the statement of charges and the return stub. Thus the customer, upon receiving the assembly, is free to tear off the stub along the line of perforations $L_4$ and to return the stub to the company, the customer retaining the statement.

Figure 4:
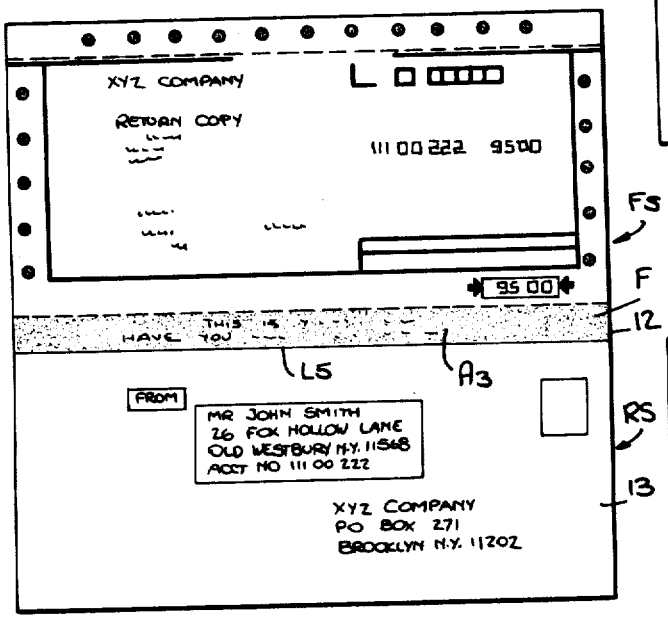
FIG. 4 shows the second folding step in creating the assembly.

As shown in FIG. 4, the second step in converting the blank into a two-way mailer involves folding lower panel 13 over down-center panel 12 on the line of perforations $L_3$. The upper end of the folded-over lower panel registers with line $L_5$ on the exposed envelope flap F to form a return section RS.

Because of adhesive bands $A_4$ and $A_5$ (FIG. 1) on the front face of lower panel 13, the side margins of the folded-over lower panel are adhered to the front face of down-center panel 12 to form a return envelope addressed to the company, into which envelope the customer inserts stub S and a payment check.

Figure 5:
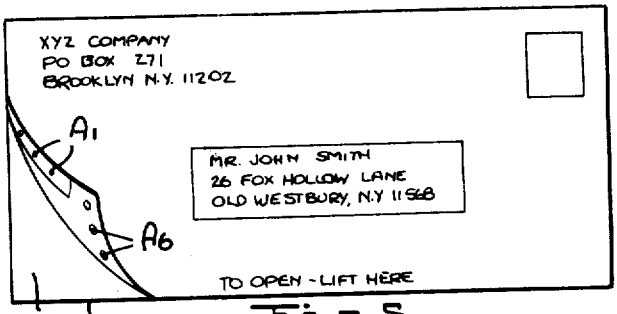
FIG. 5 shows the third and final step in forming the assembly, the assembly now being in condition for mailing by the company to the customer.

As shown in FIG. 5, the third and final step in completing the assembly involves folding forwarding section FS over return section RS.

As a consequence of this folding step, the rows of spot adhesive $A_1$ and $A_2$ on the exposed side margins of up-center panel 11 adhere to the corresponding side margins on the rear face of lower panel 13 and the row of spot adhesive $A_6$ at the end of upper panel 10 adheres to the corresponding end margin of lower panel 13, thereby temporarily bonding the folded-over forwarding section FS to the return section RS and sealing the assembly.

In practice, before the forwarding section is bonded to the return section, one may insert in the folds formed by these two sections advertising slips or other promotional inserts and notices.

Thus in the completed assembly, the address of the customer appears on the front thereof and it may therefore be mailed to him in the usual fashion.

Figure 6:
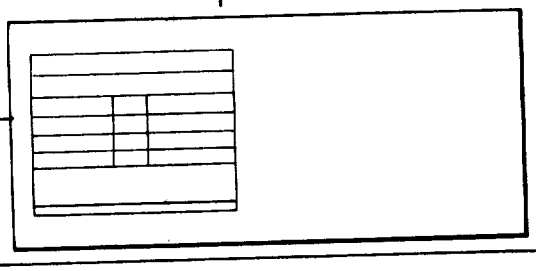
FIG. 6 shows the assembly received by a customer, after the customer has separated the forwarding section of the assembly from the return section thereof and severed the return stub from the statement.
Figure 6:
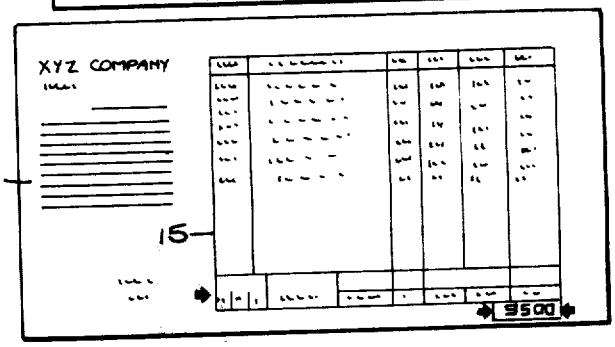
Figure 6:
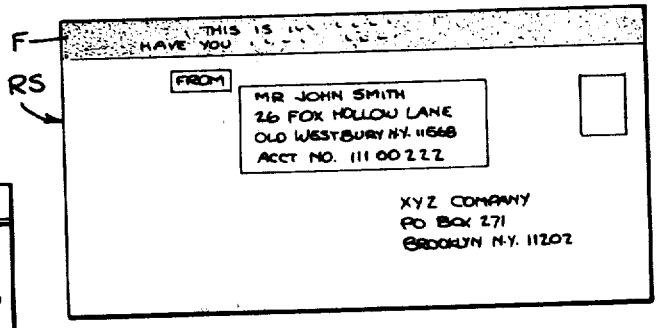

When the customer receives the two-way mailer assembly sent to him by the company, he breaks the temporary seal and unfolds the two sections. He then severs the forwarding section FS from the return section RS on the line of perforations $L_2$, thereby separating the return envelope from the statement of charges and the return stub S, as shown in FIG. 6.

Figure 7:
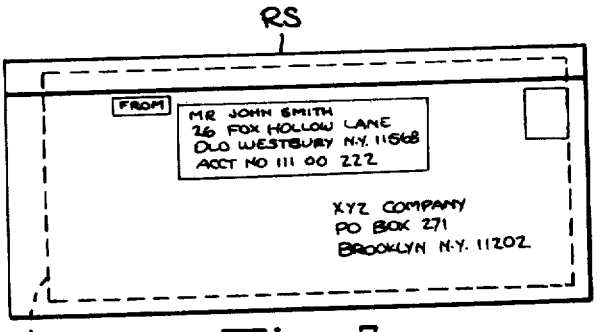
FIG. 7 illustrates the return envelope in condition for mailing to the company.

The return stub is severed from the statement which is retained by the customer, and the customer then inserts the return stub with a payment check in the return envelope. He then folds and seals flap F, as shown in FIG. 7, and mails the return envelope to the company.

When the company clerk receives the return envelope, he removes the check and the return stub therefrom. The return stub constitutes a record of the customer's payment, which may be read into a computer system capable of scanning the indicia contained on the stub.

However, in the event the customer has failed to insert the record stub in the return envelope, the clerk tears apart the return envelope to recover the duplicate record therefrom, which he then uses in place of the missing stub.

Thus a two-way mailer assembly according to the invention provides a mailing piece which includes a statement of charges, a record stub and a return envelope, the envelope incorporating a duplicate record which is useful should the customer forget to return the stub. This represents an important advantage of the invention, for in conventional billing operations, should the customer send in a check for payment which is not accompanied by a record stub, then special handling is required. And since the two-way mailer includes a duplicate record as well as a record stub, in some billing situations one may omit from the blank the upper panel and the record stub S included therein, and rely on the record contained in the return envelope so that the customer is not required to enclose a stub in the return envelope.

The Manufacturing System

Figure 8:
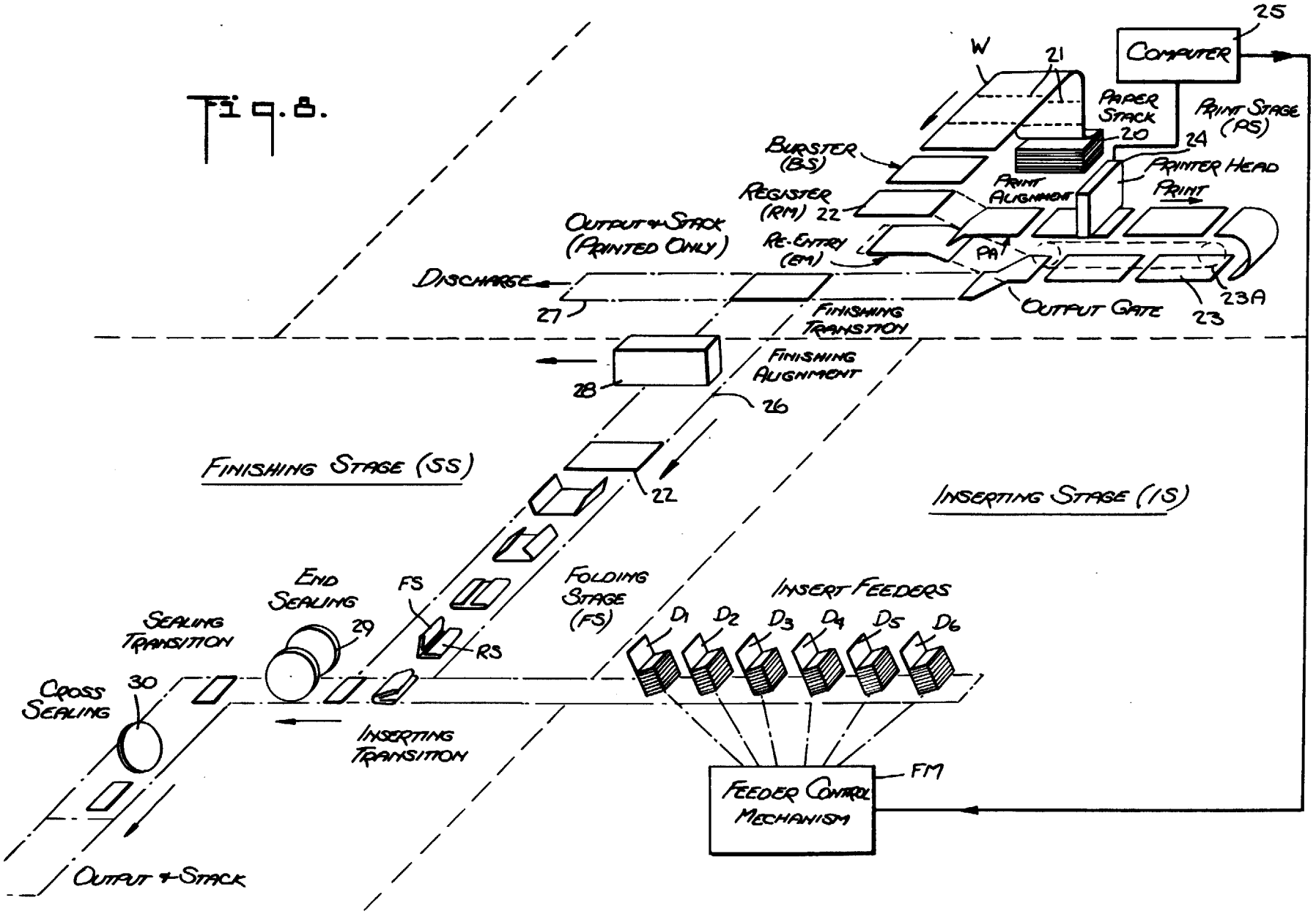
FIG. 8 is a schematic diagram of the system for producing the two-way mailer.
Figure 8:
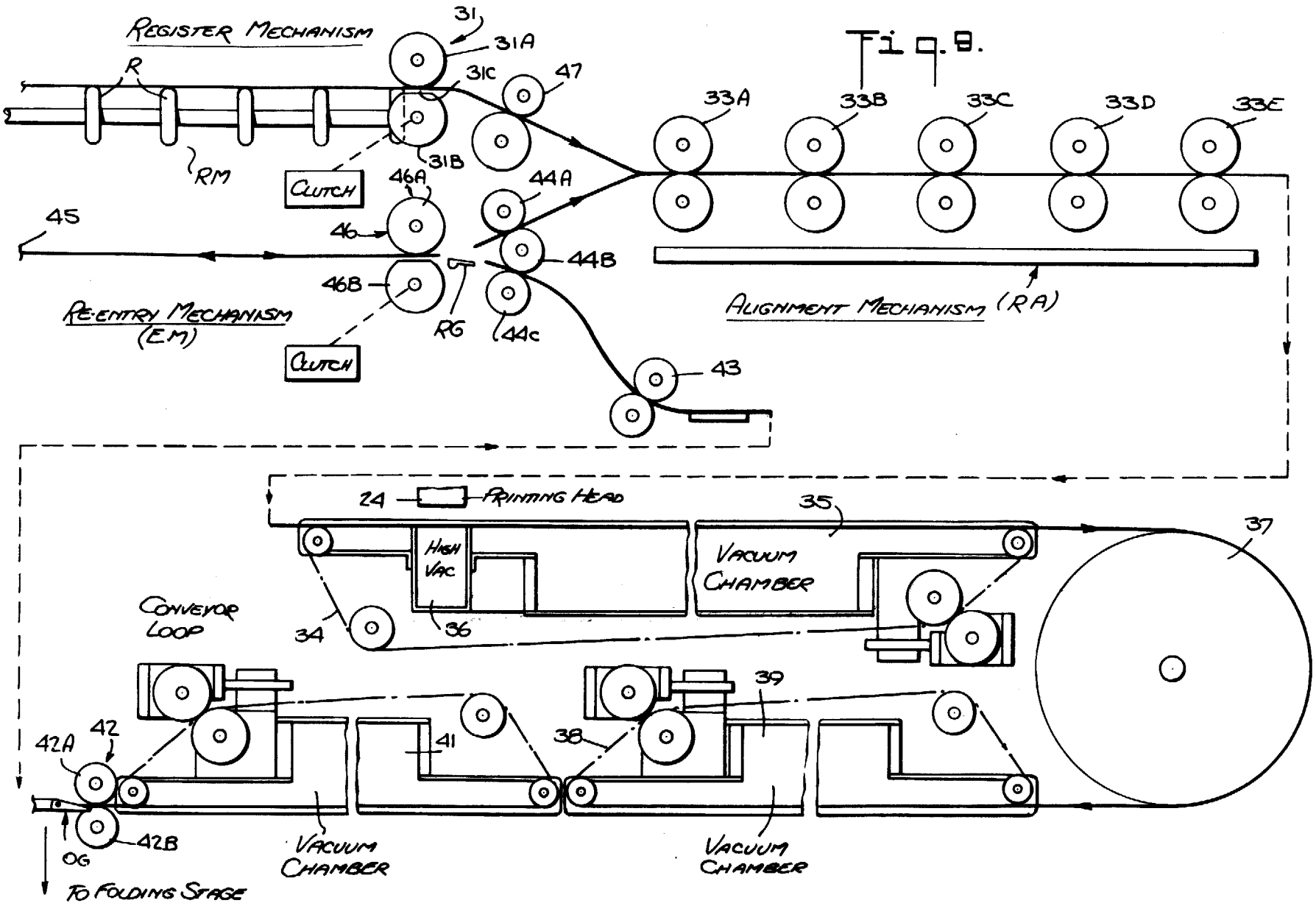

Referring now to FIG. 8, there is shown in schematic form a system in accordance with the invention for manufacturing two-way mailers of the type disclosed in FIGS. 1 to 7. In this system, a web of paper stock which has already been printed by a conventional rotary press or other standard printing machines to bear printed matter common to all blanks is provided in the form of a zig-zag paper stack 20 in which the lines of perforation 21 define the junctions between adjacent blanks. As explained previously, each blank is die cut and divided by lines of perforation into the four panels of a two-way mailer, and adhesive is applied to the blank at appropriate positions. The adhesive for this purpose is a hot-melt adhesive which, in the system, is later activated by heat and pressure to effect the necessary sealing operations to complete the mailer.

The web W drawn from stock 20 is fed into a burster stage BS which acts to separate the web into individual fresh blanks 22 and to feed these blanks into a register mechanism RM. This mechanism acts to feed the fresh blanks periodically into an alignment device PA acting to shift the blanks against a guide and to then admit the blands into the conveyor loop 23 of a printing stage PS wherein each blank is moved under an ink-jet printing head 24 and turned over. This head operates in conjunction with a computer 25 which modulates the ink jets to imprint data on the front face of the blank of the type shown in FIG. 1 relating to a given account.

The blank conveyed by loop 23, after passing under the printing head 24 and being printed thereby, is turned over as it is carried from the upper course of the loop to the lower course thereof at loop bend 23A, the blank then being advanced toward an output gate OG having tow operative positions. The gate operation is coordinated with the loop movement so that when a fresh blank completes its first run on the loop, the gate assumes its first position and passes the blank into a reentry mechanism EM which acts to readmit the blank into the loop. When the readmitted blank is printed on its reverse face and completes its second run on the loop, the gate assumes its second position to transfer the blank into the conveyor 26 of a folding stage FS, or if the printed blank is not to be further processed, into a discharge conveyor 27.

Blank 22, which has been printed on both faces thereof by a single printing head 22 before entering folding stage FG, first passes under an electronic object-character reader 28 which scans the account and form numbers or other data to provide signals to the computer terminal for accounting and other purposes. In the following folding stage FS, first the end panels of the four-panel blank are folded in to create the forwarding and return sections of the two-way mailer, and then the forwarding section is folded over the return section preparatory to sealing operations to complete the mailer.

But before the forwarding and return sections of the mailer are sealed together, suitable inserts and stuffed therebetween by means of an inserting stage IS having a row of insert dispensers $D_1$, $D_2$, $D_3$, etc., which are selectively operated and controlled by a feeder control mechanism FM activated by computer 25.

The inserts stuffed into a mailer for a given account are only those appropriate to that account. For example, if the account is in arrears, then an insert calling this fact to the accounts's attention may be appropriate. Or if the account resides in an area having a branch store that is running a special sale, an insert appropriate to that fact is dispensed. Hence only those inserts which are relevant to the account whose mailer is at that moment in line with the inserting stage are introduced between the fold of the forwarding and return sections of the mailer.

At this point, it should be noted that while it is common practice to stuff envelopes with inserts, heretofore the inserts had to be stuffed within completed envelopes. This presented difficulties, since means had to be provided to adequately dilate the envelope to receive the inserts. But in the instant arrangement, insertion takes place before the sections of the mailer are sealed together to define an envelope, which makes insertion in the fold much easier.

After insertion, the mailer passes through a pair of heated end sealers 29 of a finishing stage SS which serve to adhere the end margins of the sections together, and from there through a cross sealer 30 which applies heat and pressure in the long margin of the sections to complete the two-way mailer, after which it is delivered to an output stack for mailing to the customer. In practice, the system may include a postage meter to apply postage to the mailer after it is completed and before it is discharged from the system.

The Printing Stage

FIG. 9 shows the printing stage in greater detail. The fresh blanks from burster stage BS are fed into register mechanism RM which includes a blank ejector 31 formed by an upper cylindrical roll 31A and a driven lower roll 31B provided with a flat sector 31C, such that when the flat sector is in registration with the upper roll, there is a space therebetween and a blank interposed therebetween by feed rollers R is not gripped; but when the remaining portion of the lower roll engages the upper roll, the blank is gripped and advanced toward a set of feed-rolls 32 which feed the blank into the alignment mechanism PA.

The lower roll 31B of ejector 31 is operated through a suitable clutch so that it makes a single revolution at a time, the clutch operation being periodic, whereby ejector 31 functions to feed the blanks at spaced intervals into the feed rolls 47 for the alignment mechanism PA. The alignment mechansim is provided with a series of slanted rolls 33A to 33E which shift the blank against a guide prior to the admission of the blanks into the conveyor loop of the printing stage PS. Such alignment is important preparatory to printing to ensure proper registration of the printed matter on the blank.

The conveyor loop 23 in the printing stage is defined by an upper course constituted by a foraminous belt 34 which is pulled by driven rollers and caused to slide over the perforated platen of a first vacuum chamber 35 having a high-vacuum section 36 just below printing head 24. The vacuum functions to hold the blank flat against the belt as the blank is advanced thereby as well as to avoid any physical contact with the wet printing surface. The higher vacuum level at the printing head position is necessary to insure absolute flatness in the course of printing to avoid distortion of the print characters. The length of the loop is made such as to allow for sufficient drying time. Moreover, because the blank paper is somewhat permeable, the negative pressure produced by the vacuum serves to bleed air through the paper to promote surface drying. Drying may also be expedited by blowing heated air over the blank surface.

The bend in the conveyor loop is created by a large rotating vacuum drum 37 whose cylindrical wall is foraminous, the drum acting to transfer the advancing blank from upper course belt 34 to the first section of the lower course of the loop formed by a conveyor belt 38 cooperating with a vacuum chamber 39. The blank, in being transferred from the upper course to the lower course is turned over so that the obverse face which was printed when passing under the printing head now faces down. In practice, a stream of air may be blown between drum 37 and vacuum chambers 39 and 41 to force the traveling blanks against metal trays (not shown) and thereby constrain the motion normal to the required path of the blanks.

From the first section of the lower course of the loop, the blank is carried to the second section thereof formed by a belt 40 which cooperates with a vacuum chamber 41. At the output of the second section of the lower course is a set of output rolls 42 which act in conjunction with the two-position output gate OG.

In its first position, which is the position shown in FIG. 9, gate OG engages the lower roll 42B of output set 42, causing the blank coming out of the second section of the lower course to be directed to a feed roll set 43 acting to advance the blank toward the three-roll input-output set 44 of reentry mechanism EM, which set cooperates with a second two-position gate RG. The intermediate roll 44B of this set is driven in the clockwise direction, causing a blank interposed between this roll and lower roll 44C to move to the left into the reentry mechanism EM, and later causing a blank interposed between this roll and upper roll 44A to move to the right out of the reentry mechanism EM.

Reentry mechanism EM includes a stop 45 which arrests the movement of a blank admitted therein by a set 44 and a blank ejector 46 identical to the ejector 31 of the register mechanism FM but operating alternately therewith. Thus when a clutch is activated to effect a single revolution pf the flattened lower roll 46B of ejector 46, the blank is advanced toward the output roll of input-output set 44 and is fed thereby into the alignment mechanism PA to again run through the loop. The switching action of gate RG to direct each blank into and out of the reentry mechanism is coordinated with the clutch for roll 46B whereby prior to tripping the clutch, the gate is rotated.

Since the reentry mechanism operates in the intervals in which ejector 31 of the register stage is inactive, it serves to readmit into the loop a blank for printing on its other face between the admissions of fresh blanks therein. Upon completion of its second run in the loop, the fully printed blank upon its arrival at output gate OG, which now assumes its second operative position in which it engages upper roll 42A of output roll set 42, is directed by the gate out of the loop into the folding stage FS.

The drive mechanism (not shown) for the upper and lower courses of the loop conveyor and for the drum thereof also operates the various roll sets as well as the output gate and the alternately-operated ejectors, so that all of these mechanical components are properly coordinated, whereby in the operating sequence, fresh blanks are fed into the loop alternately with blanks printed on one face, and after each blank completes two runs in the loop, it is discharged for processing in the succeeding stages of the system to produce the two-way mailers. In practice, suitable interlock switches may be provided to shut down the drive mechanism should any error be detected at any point in the operating sequence.

The computer operation is coordinated with the drive mechanism so that the printing head prints data relevant to a given account on both faces on the same blank. This is relatively simple to accomplish, in that assuming the reentry of a given blank at a point four blanks subsequent to its first printing, the computer is operated so that it functions with this relationship in mind.

While there has been shown and described a preferred embodiment of a system for producing a two-way mailer in accordance with the invention, it will be appreciated that many changes and modifications may be made therein without, however, departing from the essential spirit thereof.

We claim:

1. In a system for printing fresh blanks on both faces thereof with a single printing head capable of imprinting blanks which lie below the head, the combination comprising:

A. a conveyor loop for transporting the blanks to be printed and having an input and an output, whereby each fresh blank admitted to the input of the loop is advanced thereby past the printing head at a position therebelow for imprinting on the obverse face of the blank, after which it is turned over and advanced toward the output thereof;

B. means periodically to feed fresh blanks to the input of the loop with an interval between each fresh blank admitted to the input and the succeeding fresh blank; and C. selective means coupled to the output of the loop to transfer each turned-over blank already printed on one face thereof back to the input of the loop in the interval between the admission thereto of fresh blanks, each of said transferred blanks being advanced past the printing head for printing on the other face thereof, said selective means functioning to discharge from the loop only those turned-over blanks printed on both faces thereof.

2. In a system as set forth in claim 1, wherein said means coupled to the output of the loop includes a gate which in one operative position transfers the turned-over blank already printed on one face thereof to a re-entry mechanism for readmission into the loop, and in another position discharges the turned-over blank printed on both faces thereof from the loop.

3. In a system as set forth in claim 2, wherein said reentry mechanism operates alternately with respect to the means periodically to feed fresh blanks into said loop.

4. In a system as set forth in claim 1, further including an alignment mechanism in advance of the input of the loop to align the blanks fed therein to assure printing registration.

5. In a system as set forth in claim 1, wherein said conveyor loop is constituted by continuous foraminous belts operating in conjunction with vacuum chambers to hold the blanks to the belts.

6. In a system as set forth in claim 1, further including a folding stage for folding blanks discharged from the loop.

7. In a system as set forth in claim 6, further including a sealing stage for sealing folded blanks emerging from the folding stage.

8. In a system as set forth in claim 1, wherein said means periodically to feed fresh blanks to the input of the loop is constituted by a register stage that includes an ejector formed by cooperating first and second rolls, the second roll having a flat sector, and means to introduce each fresh blank into the space between said flat sector and the first roll and to then cause said second roll to make a full revolution to eject the blank.

9. In a system as set forth in claim 8, wherein said means coupled to the output of the loop includes a two-position gate which in one position directs the blank to a reentry mechanism adapted to readmit the blank to the input of the loop, and in a second position to discharge the blank from the loop.

10. In a system as set forth claim 9, wherein said reentry mechanism includes an ejector identical to the ejector of the register stage and operating alternately therewith.

* * * * *